United States Patent [19]

Welsh

[11] 3,972,452

[45] Aug. 3, 1976

[54] DISPENSER CLOSURE

[75] Inventor: William Charles Welsh, Scarborough, Australia

[73] Assignee: Weltap Limited, Hong Kong

[22] Filed: Oct. 31, 1975

[21] Appl. No.: 627,649

[30] Foreign Application Priority Data

Feb. 7, 1975 Australia ..... 510/75
Apr. 30, 1975 Australia ..... 1424/75

[52] U.S. Cl. ..... 222/501; 222/505; 222/511; 251/175; 251/280

[51] Int. Cl.[2] ..... B65D 27/36

[58] Field of Search ..... 222/498, 499, 501, 511, 222/517, 544, 563, 505; 251/175, 339, 280

[56] References Cited

UNITED STATES PATENTS

| | | | |
|---|---|---|---|
| 2,075,249 | 3/1937 | Wilson | 222/501 |
| 2,714,475 | 8/1955 | Roehrich | 222/501 |
| 3,400,866 | 9/1968 | Fattori | 222/511 |

*Primary Examiner*—Allen N. Knowles
*Assistant Examiner*—Hadd Lane
*Attorney, Agent, or Firm*—William A. Drucker

[57] ABSTRACT

The invention relates to a dispenser closure formed of elastomeric material which is suitable for fitting to the discharge spout of a liquid container formed of a flexible film material such as polyethylene film and housed in a cardboard casing. The closure is provided with sealing means, the effectiveness of which is increased with increasing pressure within the container, and a diaphragm like transverse wall positioned across the discharge spout, said transverse wall being provided with an outwardly directed protrusion which is manipulated with a toggle like action to distort the transverse wall and sealing means to permit liquid to flow from the container.

8 Claims, 13 Drawing Figures

DISPENSER CLOSURE

BACKGROUND OF THE INVENTION

A dispenser closure widely used in Australia and other countries is described in Australian Patent Specification No. 446,218. Whilst generally satisfactory in use it has been known to leak particularly when the container is subjected to sudden shocks or a number of containers stacked one above the other. This particular dispenser closure suffers from the inherent disadvantage that effectiveness of the seal is dependent on the diaphragmatic transverse wall closure making sealing contact with a perpheral edge of the discharge spout which sealing contact can be broken by increasing pressure within the container.

OBJECT OF THE INVENTION

The object of the invention is to provide a dispenser closure which is substantially free of the disadvantages discussed above and in particular in which the effectiveness of the sealing means is increased with increasing pressure within the container.

DEFINITION OF THE INVENTION

In one form the invention resides in a dispenser closure comprising a tubular spout to be connected at one end to a fluid container, a diaphragmatic transverse wall of elastomeric material mounted across the other end of the spout, said transverse wall having a concave configuration which extends into said spout, an inwardly directed peripheral flange mounted on said transverse wall to sealingly engage with the inner tubular surface of said spout, a discharge outlet formed in a lower portion of said transverse wall providing communciation between the exterior of said dispenser closure and a portion of the region of sealing engagement between the tubular surface of said spout and said peripheral flange, an outwardly directed protrusion extending from said transverse wall to be manipulated to distort the transverse wall and the portion of the peripheral flange adjacent the discharge outlet to cause fluid flow from the container through the discharge outlet.

In another form the invention resides in a dispenser closure comprising a tubular spout to be connected at one end to a fluid container and diaphragmatic transverse wall of elastomeric material mounted across the other end of the spout, said transverse wall having a concave configuation which extends into said spout, an inwardly directed peripheral flange mounted on said transverse wall to sealingly engage with the inner tubular surface of said spout, a discharge outlet formed in a lower portion of said transverse wall providing communciation between the exterior of said dispenser closure and a portion of the region of sealing engagement between the inner tubular surface of said spout and said peripheral flange, an outwardly directed protrusion extending outwardly from the central portion of said transverse wall, and a gusset extending from the inner face of said transverse wall adjacent the position of said protrusion and that portion of the peripheral flange adjacent the discharge outlet so that when an upward force is applied to said protrusion said portion of the peripheral flange adjacent the discharge outlet is lifted with a toggle action to cause fluid flow from the container through the discharge outlet.

DESCRIPTION OF INVENTION

The invention will be better understood in the light of the following description of the specific embodiments shown in the accompanying drawings wherein.

Figure 1:
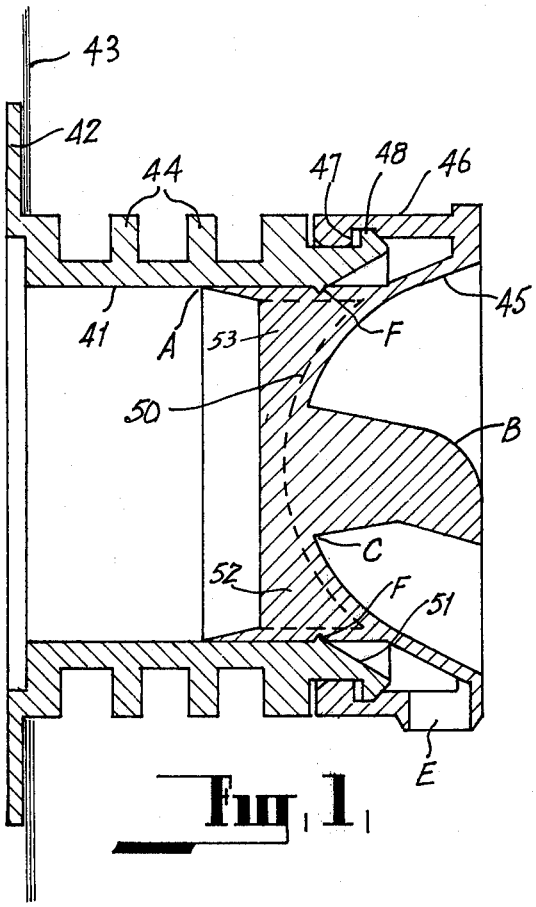
FIG. 1 is a sectional elevation of a first embodiment of the invention fitted to a discharge spout.
Figure 2:
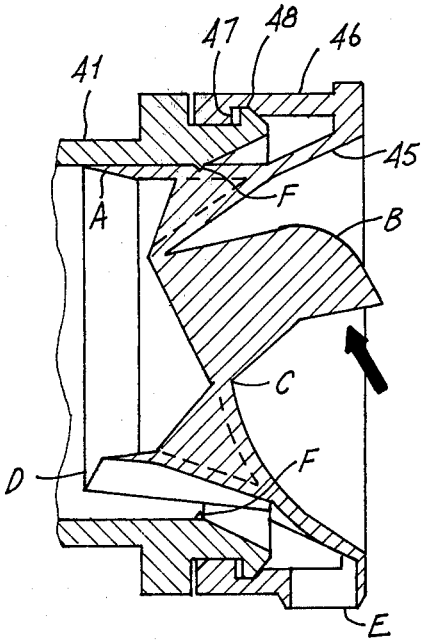
FIG. 2 is a fragmentary sectional elevation of the first embodiment showing the closure in the open position.
Figure 3:
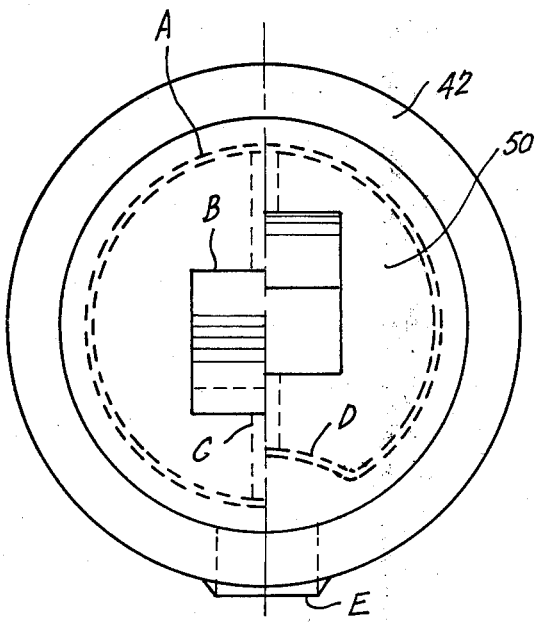
FIG. 3 is an end view of the first embodiment the left hand portion of which shows the closure in the closed position and the right hand portion of which shows the closure in the open position.
Figure 4:
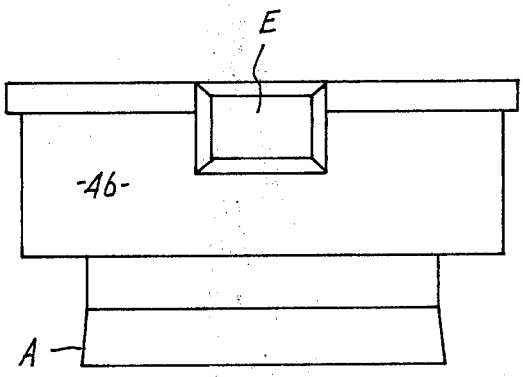
FIG. 4 is an inverted fragmentary plan view of the first embodiment showing the outlet.

The dispenser closure shown in FIGS. 1 to 4 of the drawings comprises a rigid tubular shaped spout member 41 provided at one end with an outwardly projecting flange 42 which can be sealed to wall 43 of a flexible plastic liquid container. (See FIG. 1). The spout is provided with outwardly projecting flanges 44 adapted to engage the periphery of an opening in the wall of a cardboard container (not shown) in which the liquid container is positioned. A closure member 45 formed of a suitable elastomeric material is mounted on the other end of the spout and is provided with a skirt 46, the inner periphery of which is provided with an inwardly directed flange 47 adapted to engage with an outwardly directed flange 48 on the outer end of the spout. The wall member 50 of the closure member is concave so that it projects into the spout and is provided with a peripheral flange A which tapers towards its outer end to sealingly engage against the inner face of the tubular spout. The outer end of the spout 41 is provided with an inwardly directed rib F against which the peripheral flange A also seals to provide a secondary seal. The outer inner edge of the spout is tapered outwardly as indicated by reference 51 and a discharge outlet E is provided in the lower edge of the closure member to provide communication between the exterior of the closure and the interior of the spout when the lower portion D of the peripheral flange A is lifted from sealing engagement with the inner wall of the spout and rib F as shown in FIG. 2 and in the right hand portion of Fig. 3. A protrusion or valve lift lever B projects outwardly from the central portion of the outer face of the transverse wall 50, a gusset 52 being provided on the inner face of the transverse wall 50 and the lower portion D of the peripheral flange A. A second gusset 53 is provided between the inner face of the transverse wall 50 and the upper portion of the peripheral flange A diametrically opposite to the lower portion D. When an upward pressure is applied by thumb and finger pressure on the protrusion B in the direction indicated by the arrow in FIG. 2 the portion D of the peripheral flange is lifted from sealing engagement with the inner wall of the spout and thus fluid can flow through the discharge outlet E. The upper gusset 53 provides a fulcrum about which the protrusion B can be moved to facilitate the lifting of the portion D of the peripheral flange.

Figure 5:
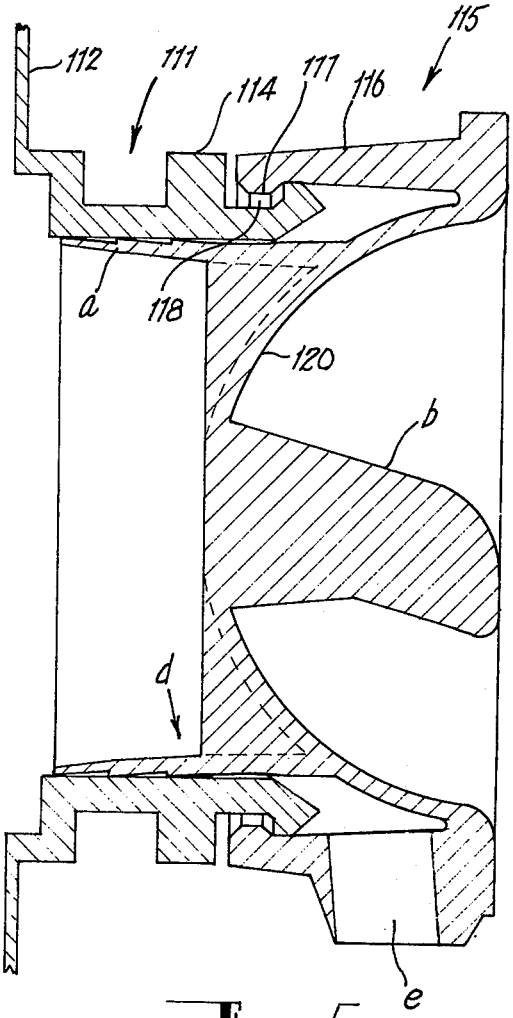
FIG. 5 is a sectional elevation of a second embodiment showing the closure in the closed position.
Figure 6:
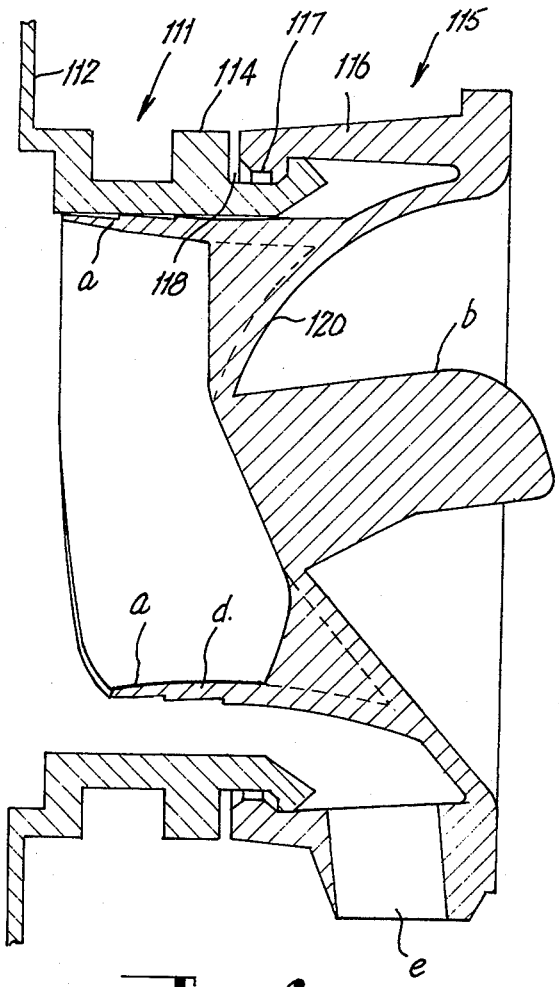
FIG. 6 is a fragmentary sectional elevation of the embodiment of FIG. 5 showing the closure in the open position.
Figure 7:
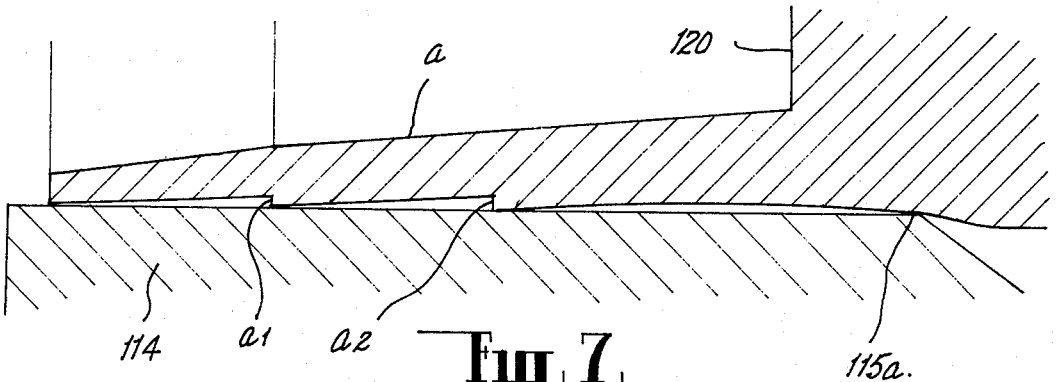
FIG. 7 is an enlarged fragmentary view of the portion of FIG. 5 enclosed in broken lines to show the sealing action more clearly.
Figure 8:
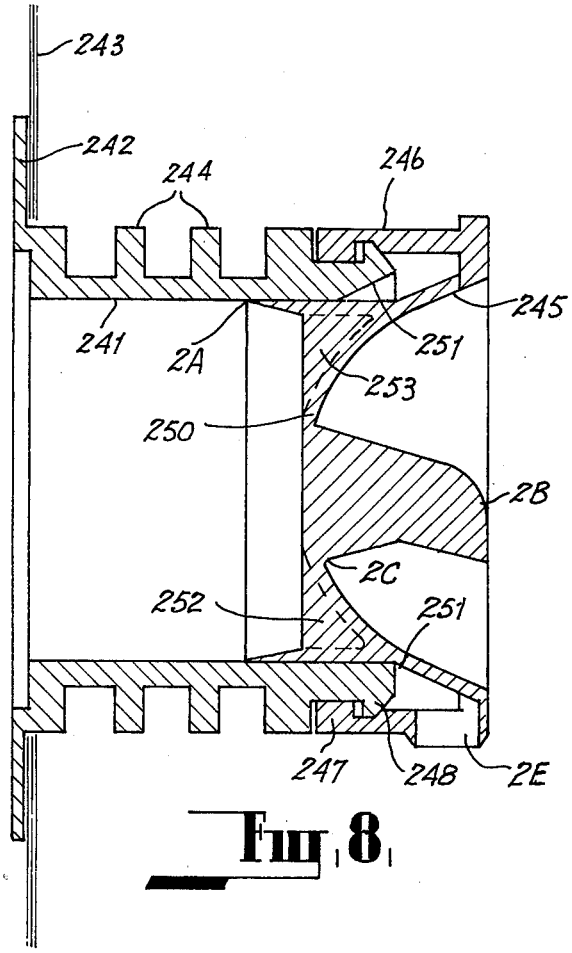
FIG. 8 is a sectional elevation of a third embodiment in the closed position.

In the second embodiment shown in FIGS. 5, 6 and 7 of the drawings the dispenser closure comprises a rigid tubular shaped spout member 111 provided at one end with an outwardly projecting flange 112 which can be sealed to wall of a flexible plastic liquid container (not shown). The spout which is shorter than the spout member 41 of the first embodiment is provided with outwardly projecting flanges 114 adapted to engage the periphery of an opening in the wall of a cardboard container (not shown) in which the liquid container is positioned. A closure member 115 formed of a suitable elastomeric material is mounted on the other end of the spout and is provided with a skirt 116 the inner periphery of which is provided with an in-wardly directed flange 117 to engage a groove 118 formed on the outside of the spout adjacent the outer end thereof. The leading inner edge of the flange 117 and the outer edge of the spout are chamfered to facilitate the engagement of the flange 117 in the groove 118.

The wall 120 of the closure member is concave so that it projects into the spout and is provided with a peripheral flange *a* which tapers towards its outer end to sealingly engage against the inner face of the tubular spout. Preferably the outer face of the flange *a* is provided with steps *a*1 and *a*2 which also sealingly engage against the inner face of the tubular spout which is best seen in FIG. 7 of the drawings. Because the flange *a* is an interference fit in the spout the outer face of the flange *a* also sealingly engages the inner edge 115*a* of the spout as is also best seen in FIG. 7 of the drawings. This multiple sealing action of the flange *a* ensures that leakage between the flange *a* and the inner face of the spout is substantially eliminated.

A discharge outlet *e* is provided in the lower edge of the closure member and provides communication between the exterior of the closure and the interior of the spout when the lower portion *d* of the peripheral flange *a* is lifted from sealing engagement with the inner wall of the spout. A protrusion or valve lift lever *b* projects outwardly from the central portion of the outer face of the transverse wall 120, gusset 122 and 123 being provided on both sides of the protrusion, on the inside of the transverse wall 120. When an upward pressure is applied by thumb and finger pressure on the protrusion *b* the portion *d* of the peripheral flange *a* is lifted from sealing engagement with the inner wall of the spout and thus fluid can flow through the discharge outlet *e*. The "toggle" action ensures positive operation of the closure whilst the peripheral flange ensures an effective seal against leakage of the contents.

Figure 9:
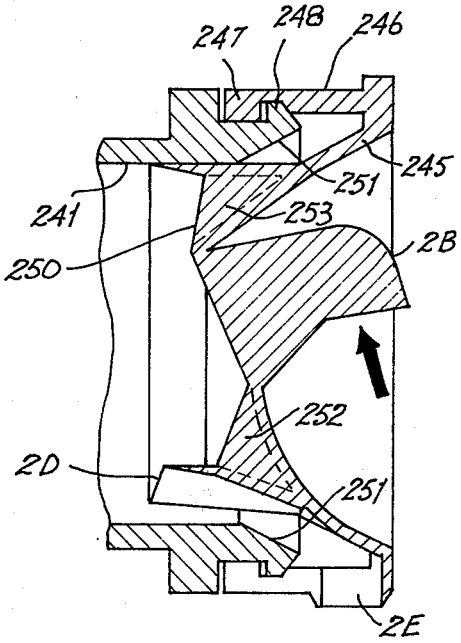
FIG. 9 is a fragmentary sectional elevation of the third embodiment showing the closure in the open position.
Figure 10:
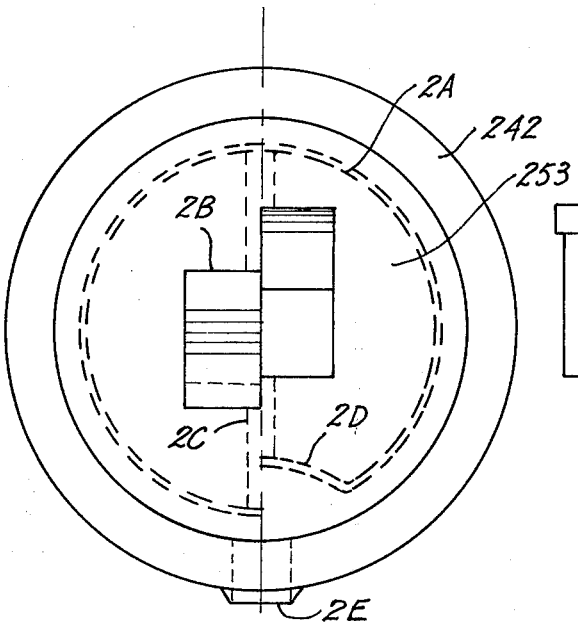
FIG. 10 is an end view of the third embodiment, the left hand portion of which shows the closure in the closed position and the right hand portion of which shows the closure in the open position.
Figure 11:
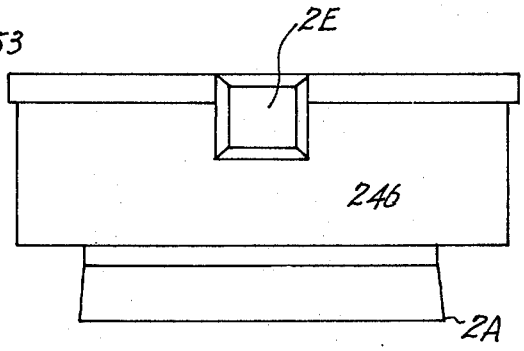
FIG. 11 is an inverted fragmentary plan view of the third embodiment showing the outlet.

The dispensure closure shown in FIGS. 8 to 11 is similar in some respects to those shown in FIGS. 1 to 4 and 5 to 7 and comprises a rigid tubular shaped spout member 241 provided at one end with an outwardly projecting flange 242 which can be sealed to wall 243 of a flelxible plastic liquid container. The spout is provided with outwardly projecting flanges 244 adapted to engage the periphery of an opening in the wall of a cardboard container (not shown) in which the liquid container is positioned. A closure member 245 formed of a suitable elastomeric material is mounted on the other end of the spout and is provided with a skirt 246, the inner periphery of which is provided with an inwardly directed flange 247 adapted to engage with an outwardly directed flange 248 on the outer end of the spout. The wall member 250 of the closure member is concave so that it projects into the spout and is provided with a periperal flange 2A which tapers towards its outer end to sealingly engage against the inner face of the tubular spout. The outer inner edge of the spout is tapered outwardly as indicated by reference 251 and a discharge outlet 2E is provided in the lower edge of the closure member to provide communication between the exterior of the closure and the interior of the spout when the lower portion D of the peripheral flange 2A is lifted from sealing engagement with the inner wall of the spout as shown in FIG. 9 and in the right hand portion of FIG. 10. A protrusion or valve lift lever 2B projects outwardly from the central portion of the outer face of the transverse wall 250, a gusset 252 being provided on the inner face of the transverse wall 250 and the lower portion 2D of the peripheral flange 2A. A second gusset 253 is provided between the inner face of the transverse wall 250 and the upper portion of the peripheral flange A diametrically opposite to the lower portion 2D. When an upward pressure is applied by thumb and finger pressure on the protrusion 2B in the direction indicated by the arrow in FIG. 9 the portion 2D of the peripheral flange is lifted from sealing engagement with the inner wall of the spout and thus fluid can flow through the discharge outlet 2E. The upper gusset 253 provides a fulcrum about which the protrusion 2B can be moved to facilitate the lifting of the portion 2D of the peripheral flange.

Figure 12:
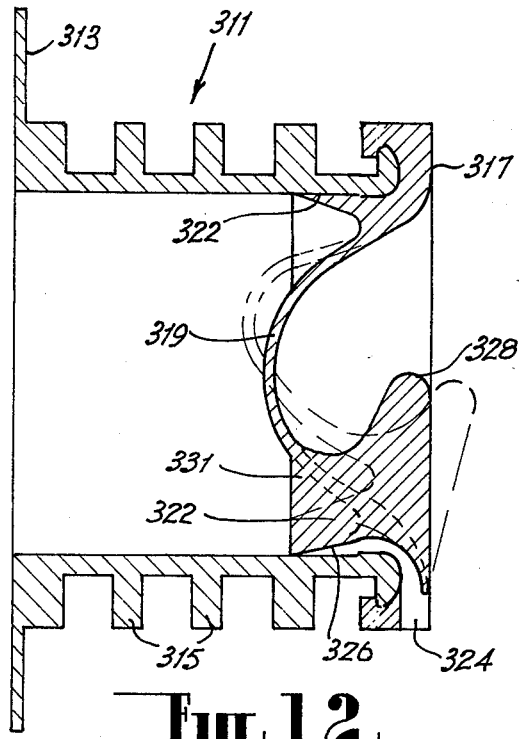
FIG. 12 is a sectional view of a fourth embodiment fitted to a dispensing spout.
Figure 13:
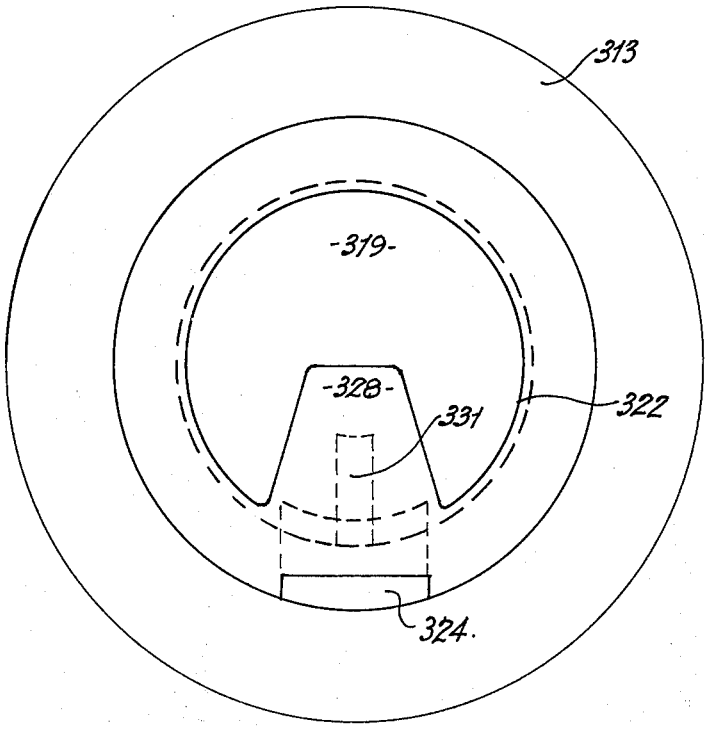
FIG. 13 is an end elevation of the embodiment of FIG. 12.

The dispenser closure of the embodiment shown in FIGS. 12 and 13 comprises rigid tubular shaped spout member 311. Flange 313 is provided at one end for fixing by suitable means to a flexible plastic liquid storage container. Flange 315 on the spout are intended for the mounting of packaging to the spout, the packaging being intended to support and protect the flexible plastic container. A closure member 317 is mounted to the other end of the spout member 311. The closure member 317 is formed from a suitable plastic material having elastomeric properties. The closure member comprises a wall 319 transversely positioned across the spout having a sealing outer periphery which sealingly engages a lip 320 at the outer end of the spout. The wall 319 is concave in configuration and extends inwardly into the spout. A peripheral flange 322 is mounted on the wall such that it is in sealing contact with the inner surface of the spout 11. A discharge outlet 324 is provided in the lower edge of the closure member and provides communication between the exterior of the closure and the lower portion 325 of the region where the peripheral flange 322 sealingly engages the inner surface of the spout 311. The wall 319 has mounted at its lower portion above the discharge outlet 324 a protrusion 328. On the internal surface of the wall opposite the protrusion 328 the peripheral flange 322 and wall 319 are interconnected by a rib portion 331 causing the lower portion of the peripheral flange 322 adjacent the discharge outlet to be rigidly attached to the wall 319. As a result of the mounting relationship of the protrusion 328 and rib portion 331, upon finger pressure on the protrusion pulling it outwardly (as shown by the broken lines) the wall 311 and peripheral flange 322 are deformed causing fluid to flow from the spout through the discharge outlet. The dispenser closure of the embodiment is of a simple two piece construction which lends itself readily to manufacture and the filling and packaging of flexible plastic containers. The fitting of the closure member 317 to the spout 311 provides a fluid tight seal between the two components by virtue of the peripheral flange 322. In addition upon the filling of the container to which the spout is attached fluid pressure on the rear of the wall 311 produces a radially outwardly directed force on the wall to further enhance the sealing around its edge to the spout.

The dispenser closures of the embodiments described above are particularly suitable for use on containers adapted to be filled with wine and are suitable for use with carbonated or sparkling wines and other carbonated beverages such as aerated waters and beer.

In yet another embodiment the closure may be used for large sized containers for milk and like liquids which do not require to be dispensed in small quantities by eliminating the protrusions B (FIGS. 1 to 4) or *b* (FIGS. 5 to 7) or IB (FIGS. 8 to 11) and 328 (FIGS. 12 and 13) and making provision for the wall 20 (FIGS. 1 to 4) or 250 (FIGS. 8 to 11) to be removed by tearing or cutting to permit the contents of the container to be discharged.

I claim:

1. A dispenser closure comprising a tubular spout to be connected at one end to a fluid container, and a diaphragmatic transverse wall of elastomeric material mounted across the other end of the spout, said transverse wall having a concave configuration which extends into said spout, an inwardly directed peripheral flange mounted on said transverse wall to sealingly engage with the inner tubular surface of said spout, a discharge outlet formed in a lower portion of said transverse wall providing communication between the exterior of said dispenser closure and a portion of the region of sealing engagement between the tubular surface of said spout and said peripheral flange, an outwardly directed protrusion extending from said transverse wall to be manipulated to distort the transverse wall and the portion of the peripheral flange adjacent the discharge outlet to cause fluid flow from the container through the discharge outlet.

2. A dispenser closure comprising a tubular spout to be connected at one end to a fluid container and diaphragmatic transverse wall of elastomeric material mounted across the other end of the spout, said transverse wall having a concave configuration which extends into said spout, an inwardly directed peripheral flange mounted on said transverse wall to sealingly engage with the inner tubular surface of said spout a discharge outlet formed in a lower portion of said transverse wall providing communication between the exterior of said dispenser closure and a portion of the region of sealing engagement between the inner tubular surface of said spout and said peripheral flange, an outwardly directed protrusion extending outwardly from the central portion of said transverse wall, and a gusset extending from the inner face of said transverse wall adjacent the position of said protrusion and that portion of the peripheral flange adjacent the discharge outlet so that when an upward force is applied to said protrusion said portionof the peripheral flange adjacent the discharge outlet is lifted with a toggle action to cause fluid flow from the container through the discharge outlet.

3. A dispenser closure as claimed in claim 1 wherein the outer end of the spout is provided with an inwardly directed rig against which the inwardly directed peripheral flange seats to provide a secondary seal.

4. A dispenser closure as claimed in claim 2 wherein a second gusset is provided between the inner face of the transverse wall and the upper portion of the inwardly directed peripheral flange diametrically opposite the first gusset.

5. A dispenser closure as claimed in claim 1 wherein the outer inner edge of the spout is tapered outwardly.

6. A dispenser closure as claimed in claim 2 wherein a second gusset is provided between the inner face of transverse wall and the inwardly directed peripheral flange to form a continuation of the first gusset.

7. A dispenser closure as claimed in claim 1 wherein the protrusion projects outwardly and upwardly and the internal surface of the wall opposite the protrusion and the peripheral flange are interconnected by a rib portion so that when a downward pressure is applied to the protrusion the peripheral flange connected to the rib portion is lifted out of sealing engagement with the inner face of the spout.

8. A dispenser closure as claimed in claim 1 wherein the face of the peripheral flange in contact with the inner face of the spout is provided with one or more steps for increased sealing contact.

* * * * *